US006213278B1

(12) United States Patent
Tanigawa

(10) Patent No.: US 6,213,278 B1
(45) Date of Patent: Apr. 10, 2001

(54) MAN-CONVEYOR STEP

(75) Inventor: Joji Tanigawa, Chiba Pref (JP)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/296,884

(22) Filed: Apr. 22, 1999

(51) Int. Cl.[7] ..... B66B 9/12
(52) U.S. Cl. ..... 198/333; 198/326
(58) Field of Search ..... 198/333, 326

(56) References Cited

U.S. PATENT DOCUMENTS 3,616,891 * 11/1971 Earle ..... 198/16
3,986,595 * 10/1976 Asano et al. ..... 198/333
4,236,623 * 12/1980 Ackert ..... 198/333
4,397,383 * 8/1983 James ..... 198/333
4,413,719 * 11/1983 White ..... 198/333
4,519,490 * 5/1985 White ..... 198/333
4,570,781 * 2/1986 Kappenhagen ..... 198/333
4,638,901 * 1/1987 Lunardi ..... 198/323
4,726,463 * 2/1988 Babler ..... 198/333
4,805,757 * 2/1989 Wilcox ..... 198/333
4,858,745 * 8/1989 Haas et al. ..... 198/333
4,953,686 * 9/1990 Ruilke ..... 198/332
5,082,102 * 1/1992 Reichmuth ..... 198/333
5,242,042 * 9/1993 Mauldin ..... 198/333
5,560,468 * 10/1996 Inoue ..... 198/333
5,810,147 * 9/1998 Vanmoor ..... 198/323

* cited by examiner

*Primary Examiner*—Christopher P. Ellis
*Assistant Examiner*—Rashmi Sharma

(57) ABSTRACT

To avoid a step from drawing in the clothing, etc., of a passenger when the passenger is on the moving step, an escalator step 1 comprising a tread part 2 and a riser part 3, includes guard panels 6, 7 which are installed on both sides of the tread part 2 in the direction of step motion.

4 Claims, 2 Drawing Sheets

MAN-CONVEYOR STEP

TECHNICAL FIELD

The present invention pertains to a step of an escalator, which is made to prevent drawing in of clothing, etc. of a passenger when the passenger uses the escalator.

BACKGROUND OF THE INVENTION

As an escalator of prior art, for instance, one that is illustrated in FIG. 4 is available. It is comprised as follows. Steps 101 are endlessly connected with a chain, which is continuously driven, and convey passengers in a moving step system. On both sides of the steps 101, hand rails 102 are provided for the safety of the passengers. Below these, skirt guards 103 are installed.

However, as there may be a gap between the moving steps 101 and the skirt guard 103 on this type of escalator, if a passenger on the step 101 is wearing a long skirt, or other clothing, there is a possibility that the hem of this long skirt may fall between the step 101 and the skirt guard 103, and eventually be drawn in by the moving step 101 and torn off.

DISCLOSURE OF THE INVENTION

The objective of the present invention is to prevent the clothing of a passenger on a moving step from being drawn in by the step.

To realize this objective, according to the present invention, for a step of an escalator having a tread part and a riser part, guard panels are provided on both sides of the tread part in the step conveyance direction.

BEST MODE FOR CARRYING OUT THE INVENTION

Application Mode of the Invention

Figure 1:
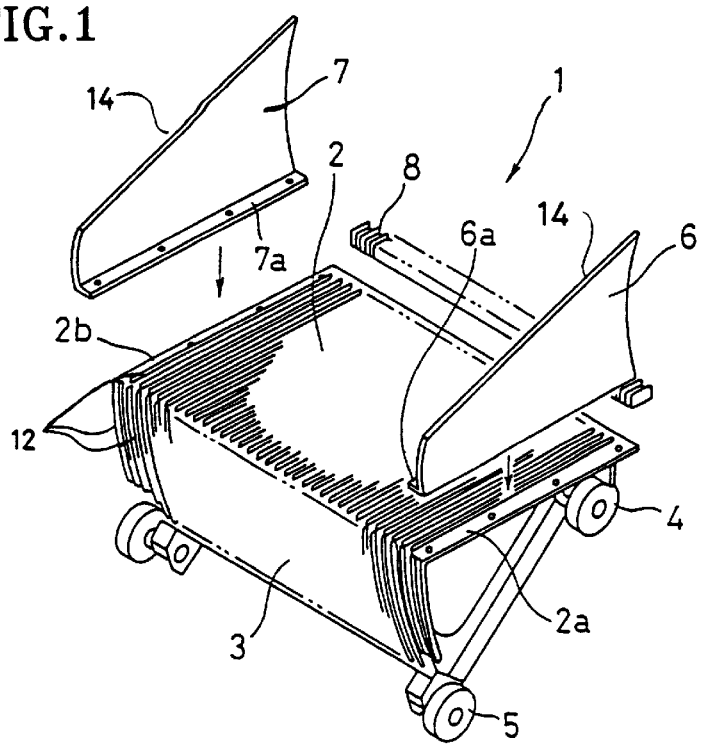
FIG. 1 is an oblique view that illustrates an application example of a step of a passenger conveyor (escalator) that pertains to the present invention.
Figure 2:
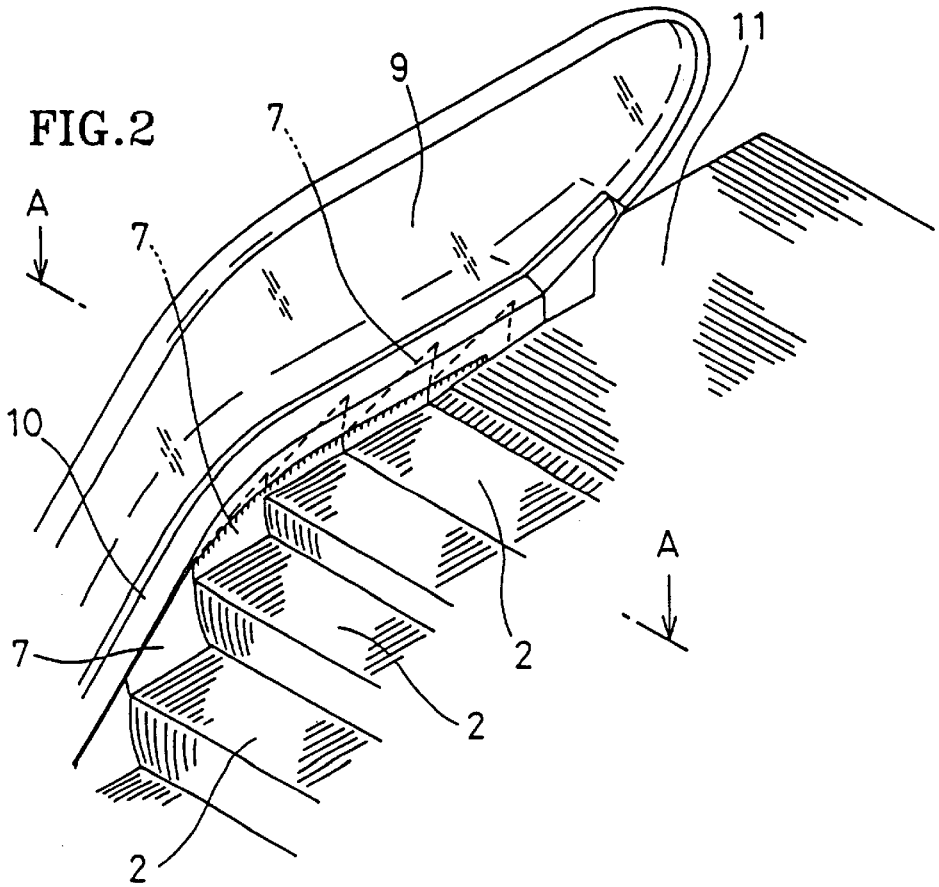
FIG. 2 is an oblique view of an escalator wherein this step is used.
Figure 4:
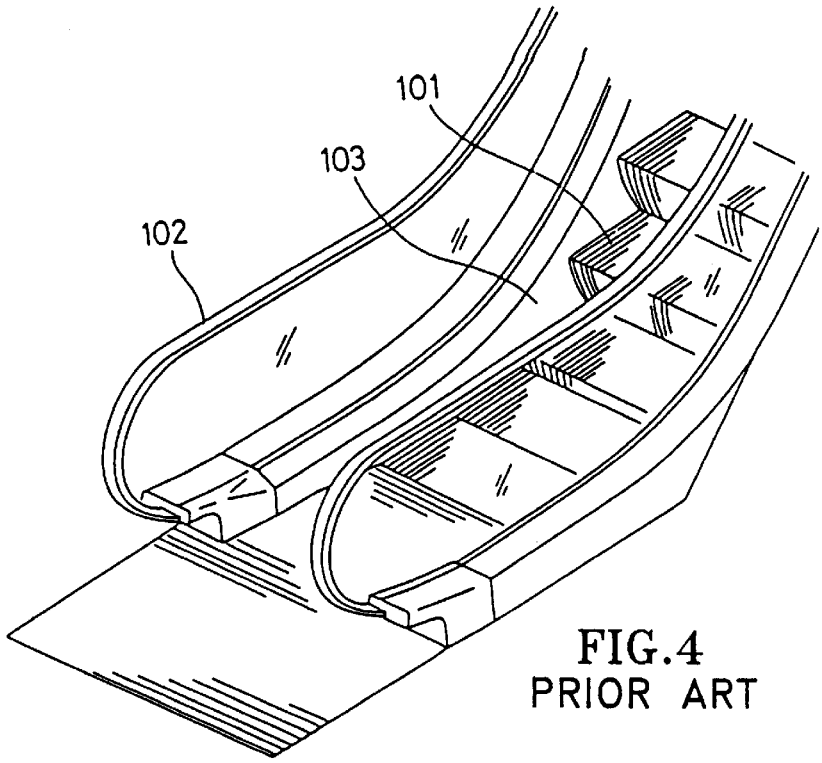
FIG.4 PRIOR ART
FIG. 4 is an overview of a typical prior art escalator installation.
Figure 3:
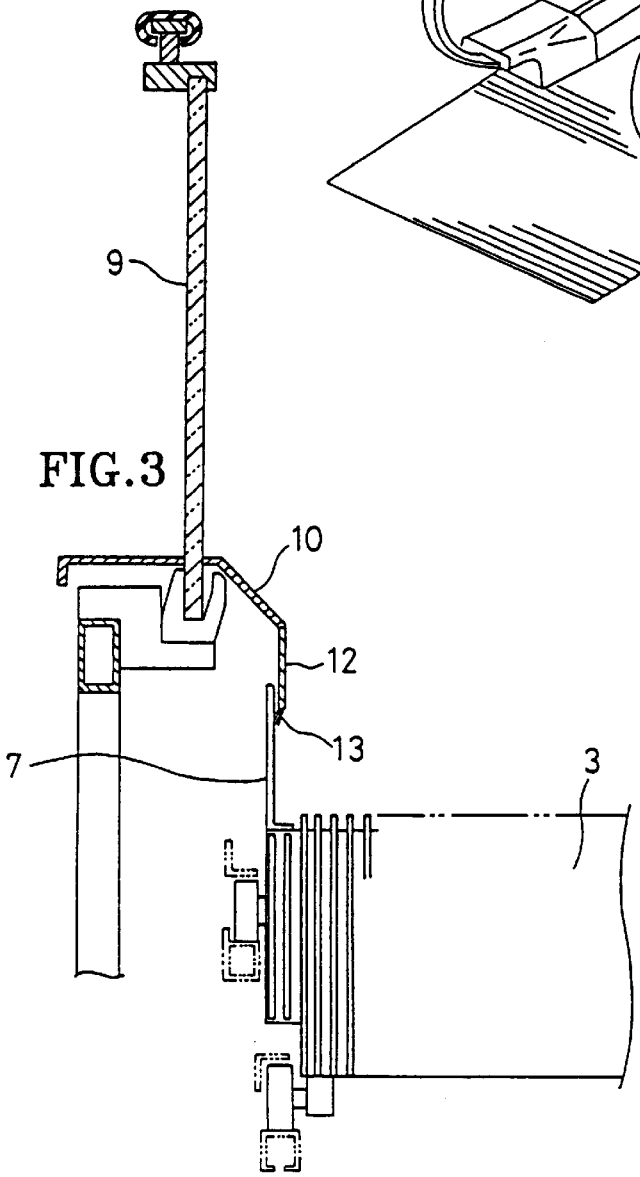
FIG. 3 is a cross-sectional view along Line A—A in FIG. 2.

Next, the present invention will be explained based on the figures. FIG. 1 through FIG. 3 are diagrams that illustrate an application example of an escalator step according to the present invention.

In FIG. 1, the step 1 (for instance, composed of die cast aluminum) of an escalator is for passengers to step on. It comprises a flat tread part 2 that is typically rectangularly shaped, and a riser part 3, which is integrally formed with this tread part 2 and has an approximately arc shaped cross-section. Many cleats (12) are formed on both the tread part 2 and the riser part 3. In the front and the rear sides in the conveyance direction of the step on the step 1, a chain roller 4 and a roller 5 are installed in a freely rotatable state. The chain roller 4 is joined with a chain (not illustrated), and this chain is made to orbit in the form of a closed loop by a driving means.

According to the present invention, installation rims 2*a*, 2*b* are formed on both sides of the tread part 2 of the step 1 in the step conveyance direction, and guard panels 6, 7 are installed on these installation rims 2*a*, 2*b*. The guard panels 6, 7 are formed with the upper side inclined (14). The lower side is formed into an approximately L-letter shaped cross-section. These lower sides constitute the installation ends 6*a*, 7*a*. These guard panels 6, 7 may be painted yellow so as to attract attention of the passengers. By attaching the installation ends 6*a*, 7*a* of the guard panels 6, 7 to the installation rims 2*a*, 2*b* of the step 1 with bolts, a pair of guard panels 6, 7 are installed on both sides of the tread part 2 in the step conveyance direction of the tread part 2. At the front end in the step conveyance direction of the tread part 2 of the step 1, a demarcation 8 is installed.

As illustrated in FIG. 2, when the steps 1 are in the form of a stairway (incline), the guard panel 7 that is installed on the step 1 moves along the interior ledge 10 on the lower side of the glass 9. As will be appreciated by those skilled in the art, the guard panel 7, according to the present invention, replaces its conventional skirt guard and is installed not on the guide rail side but on the step. Thus, the hem of the long skirt of a passenger on the step 1 will not fall between this step 1 and the guard panel 7, and it will not be drawn in by the step 1.

Next, as more than one of these steps 1 approach the landing plate 11 and more than one of these tread parts 2 begin to constitute a flat face as a whole, the upper end of the guard panel 7 that is installed on these steps 1 will be in a notched state. Thus, a space will be generated between the interior ledge 10 and the upper end of the guard panel 7. Then, as illustrated in FIG. 3, a miniskirt panel 12 is installed on the interior ledge 10, and the aforementioned space will be covered with this miniskirt panel 12. Also, a brush 13 is installed at the tip of the miniskirt panel 12. In this manner, since the miniskirt panel 12 is installed on the interior ledge 10, the hem of a long skirt of a passenger on the step 1 will not enter or be drawn between the interior ledge 10 and the guard panel 7. While the miniskirt panel 12 on the upper side is illustrated, needless to mention, a miniskirt panel is also installed on the lower side.

While an example was described wherein the present invention is applied to an escalator, it can naturally be applied to a moving sidewalk, too, with the appropriate modification of the upper sides 14.

As will be appreciated by those skilled in the art and as explained above, according to the present invention, since guard panels are installed on both sides of the tread part of a step in the step conveyance direction, the hem of a long skirt, etc. of a passenger on the step will not fall between the step and the guard panel. It will not be drawn in by the step.

Various changes to the above description may be made without departing from the spirit and scope of the present invention as would be obvious to one of ordinary skill in the art of the present invention.

What is claimed is:

1. A moving step in a passenger conveyance system, including a horizontal tread moving in an inclined longitudinal direction adjacent a longitudinal extending ledge, the tread further comprising:

a guard panel, secured to a lateral edge of the tread and extending vertically upward therefrom, the guard panel further comprising an upper side, said upper side inclined to correspond with the inclined tread motion.

2. The step as recited in claim 1, further comprising:

a second longitudinally extending ledge spaced laterally from the first ledge and disposed adjacent a second lateral edge of the tread, and a second guard panel secured to the second lateral edge and extending vertically upward therefrom, the second guard panel further comprising a second upper side inclined to correspond with the inclined tread motion.

3. The step as recited in claim 1, wherein the conveyance system further includes a transition from inclined motion to horizontal motion, and wherein the system further includes, a mini-skirt secured to the ledge and extending longitudinally therewith, said mini-skirt further disposed laterally inward of the guard panel and extending locally vertically from my point adjacent the tread to a point above the upper side of the guard panel.

4. The step as recited in claim 3 wherein the conveyance system further includes, a second mini-skirt secured to the second ledge and extending longitudinally therewith, said second mini-skirt further disposed laterally inward of the second guard panel and extending locally vertically from a point adjacent the tread to a point above the second upper side of the second guard panel.

* * * * *